US009136635B2

(12) United States Patent
Muro

(10) Patent No.: US 9,136,635 B2
(45) Date of Patent: Sep. 15, 2015

(54) TERMINAL

(75) Inventor: Takashi Muro, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 74 days.

(21) Appl. No.: 13/997,124

(22) PCT Filed: Dec. 22, 2011

(86) PCT No.: PCT/JP2011/079821
§ 371 (c)(1),
(2), (4) Date: Jun. 21, 2013

(87) PCT Pub. No.: WO2012/086759
PCT Pub. Date: Jun. 28, 2012

(65) Prior Publication Data

US 2013/0273782 A1 Oct. 17, 2013

(30) Foreign Application Priority Data

Dec. 24, 2010 (JP) ..... 2010-288104

(51) Int. Cl.
*H01R 33/00* (2006.01)
*H01R 13/514* (2006.01)
*H01R 12/57* (2011.01)
*H01R 43/16* (2006.01)

(52) U.S. Cl.
CPC ..... *H01R 13/514* (2013.01); *H01R 12/57* (2013.01); *H01R 43/16* (2013.01)

(58) Field of Classification Search
CPC .. H01R 12/724; H01R 13/6466; H01R 12/62; H01R 12/707; H01R 12/73; H01R 13/6658
USPC ..... 439/79, 83, 660
See application file for complete search history.

(56) References Cited

U.S. PATENT DOCUMENTS 5,008,555 A 4/1991 Mundy
5,074,039 A * 12/1991 Hillbish et al. ..... 29/883
5,104,324 A * 4/1992 Grabbe et al. ..... 439/62
5,273,442 A * 12/1993 Laub ..... 439/73

(Continued)

FOREIGN PATENT DOCUMENTS

CN 2632879 Y 8/2004
JP 5-206359 A 8/1993

(Continued)

OTHER PUBLICATIONS

Korean Office Action for the related Korean Patent Application No. 10-2013-7015927 dated Mar. 18, 2014.

(Continued)

*Primary Examiner* — Truc Nguyen
(74) *Attorney, Agent, or Firm* — Kenealy Vaidya LLP

(57) ABSTRACT

For obtaining a terminal capable of being soldered to a substrate without causing trouble such as a short circuit or poor connection, a lead part 13 is plated with tin in a state joined to a joining part 42 of a carrier, and a notch part 44, whose thickness is thinned, cut by a cutter 51 from a soldering surface side for making connection to a conductor pattern is formed between the lead part 13 and the joining part 42. The notch part 44 is provided with a guide part for guiding the cutter 51 to a side of the joining part 42 and forming a fillet forming piece 17 made of a part of the notch part 44 on a side of the lead part 13 after cutting by the cutter 51.

9 Claims, 4 Drawing Sheets

(56) References Cited

U.S. PATENT DOCUMENTS

| | | | | | |
|---|---|---|---|---|---|
| 5,945,727 | A | * | 8/1999 | Ishiwa | 257/666 |
| 5,957,739 | A | * | 9/1999 | Bianca et al. | 439/885 |
| 6,004,160 | A | * | 12/1999 | Korsunsky et al. | 439/660 |
| 6,083,051 | A | * | 7/2000 | Chang | 439/660 |
| 6,155,886 | A | * | 12/2000 | Koseki et al. | 439/736 |
| 6,165,028 | A | * | 12/2000 | Hirai et al. | 439/857 |
| 6,203,335 | B1 | * | 3/2001 | Chang | 439/79 |
| 6,575,773 | B1 | * | 6/2003 | Takeuchi | 439/79 |
| 7,241,150 | B2 | * | 7/2007 | Aihara | 439/83 |

FOREIGN PATENT DOCUMENTS

| | | | |
|---|---|---|---|
| JP | 8-306844 | A | 11/1996 |
| JP | 11-154780 | A | 6/1999 |
| JP | 2006-269282 | A | 10/2006 |
| JP | 2009-158325 | A | 7/2009 |

OTHER PUBLICATIONS

International Search Report and Written Opinion of the International Search Report for PCT/JP2011/079821 dated Feb. 28, 2012.

Chinese Office Action and Search Report for the related Chinese Patent Application No. 201180062558.7 dated Feb. 3, 2015.

* cited by examiner

TERMINAL

TECHNICAL FIELD

The present invention relates to a terminal which is received in a housing of a connector and is soldered on a wiring substrate.

BACKGROUND ART

Generally, in order to make electrical connection between a wiring substrate and a cable, a connector for substrate is mounted on the wiring substrate, and a connector of the cable side is connected to this connector for substrate.

This connector for substrate has plural terminals made of metal inside a housing, and these terminals are soldered and connected to a conductor pattern of the wiring substrate on which the connector is mounted.

As shown in FIG. 7, this kind of terminal 1 has a tab 2 inserted into a housing and received in a connector, and a lead part 3 soldered to a conductor pattern of a wiring substrate. The plural terminals 1 are formed in a chain shape joined by joining parts 5 extending from a carrier 4 by pressing a metal plate, and are used by being cut and separated from the joining parts 5 (see Patent Reference 1).

PRIOR ART REFERENCE

Patent Reference

Patent Reference 1: JP-A-2009-158325

Disclosure of the Invention

Problems that the Invention is to Solve

Incidentally, in the terminal 1 described above, the joining parts 5 are joined to both sides so as to pinch the tab 2 inserted into the housing, so that when the terminal 1 is cut and separated in the joining parts 5, burrs are formed on both sides of the terminal 1.

When the burrs are formed on both sides of the terminal 1, a creepage distance between pitches of the adjacent terminals 1 is not ensured sufficiently and a short circuit may occur in the case of being received in the connector. Also, in the case of receiving the terminal 1 in the housing, the burrs chip an inner wall of a housing receiving part to generate chips, and the chips may cause poor connection in the case of soldering the terminal 1.

The invention has been implemented in view of the circumstances described above, and an object of the invention is to provide a terminal capable of being received in a housing of a connector and being well soldered to a substrate without causing trouble such as a short circuit or poor connection.

Means for Solving the Problems

The object according to the invention is achieved by the following configurations.

(1) A terminal, comprising a connecting part connected to a terminal of the other connector, and a lead part soldered to a conductor pattern of a circuit substrate, wherein the terminal is molded in a state joined to a joining part extending from a carrier by pressing a conductive metal material and is used by being cut and separated from the carrier, the lead part is plated with tin, and a notch part, whose thickness is thinned, cut from a surface side soldered to the conductor pattern by a cutter is had between the lead part and the joining part, and the notch part is provided with a guide part for guiding the cutter to a side of the joining part and forming a fillet forming piece made of a part of the notch part on a side of the lead part after cutting of the notch part by the cutter.

According to the terminal with the configuration of the above (1), when the notch part is cut by the cutter, by the guide part, the cutter is guided to the side of the joining part and the fillet forming piece made of a part of the notch part is formed on the end of the lead part after cutting of the notch part by the cutter. This fillet forming piece is deformed by the cutter and is formed in a shape warped to the side opposite to the side soldered to the conductor pattern in the lead part.

Consequently, according to this terminal, a large area of a tin-plated portion to which solder is fastened can be ensured in the end of the lead part on which the fillet forming piece is formed, and a large solder fillet is formed on a solder part in the case of soldering. Hence, even when the joining part of the carrier is joined to the back end of the lead part and the terminal is cut and separated in this joined place, the lead part can extremely well be soldered and fixed to the conductor pattern of the circuit substrate without performing complicated post plating processing with respect to its cut place.

Also, since the end of the lead part is joined to the joining part of the carrier, occurrence of burrs on both sides can be eliminated as compared with a conventional structure in which both sides of the intermediate part are joined to the joining part of the carrier. Accordingly, trouble in which a creepage distance between the adjacent terminals is not ensured sufficiently and a short circuit occurs can be prevented surely. Also, in the case of being received in the connector, there is no situation in which burrs chip the connector and the chips cause poor connection.

In addition, when the top of the connecting part is joined to the joining part of the carrier, burrs on both sides of the terminal do not occur, but burrs may occur on the top of the connecting part and become an obstacle to connection to a terminal of the other connector. However, in the configuration described above, the joining part of the carrier is joined to the end of the lead part, so that occurrence of the burrs on the connecting part can be prevented and hence, connection to the terminal of the other connector can be made well and smoothly.

(2) A terminal with the configuration of the above (1), wherein the guide part has a guide surface bulging in a circular arc shape.

According to the terminal with the configuration of the above (2), the cutter can naturally smoothly be guided to the side of the joining part to form the fillet forming piece on the side of the lead part by the guide surface bulging in the circular arc shape on the guide part.

MODE FOR CARRYING OUT THE INVENTION

An embodiment according to the invention will hereinafter be described with reference to the drawings.

Figure 1:
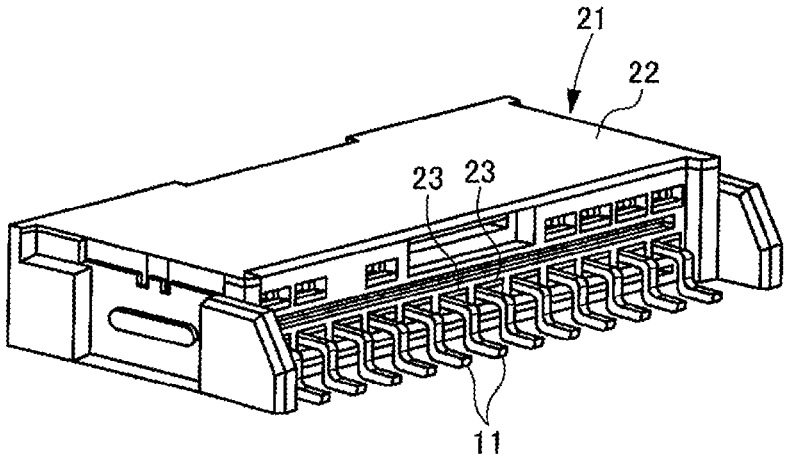
FIG. 1 is a perspective view seen from the back side of a connector in which a terminal according to one embodiment of the invention is used.

As shown in FIG. 1, terminals 11 according to the present embodiment are received in a connector 21. The connector 21 has a housing 22 made of synthetic resin, and the front end side of the housing 22 has a fitting part (not shown) into which the other connector (not shown) can be fitted. Plural cavities 23 arranged in a width direction are formed inside the housing 22, and these cavities 23 are opened in the back end side of the housing 22. Then, the terminals 11 are inserted into the cavities 23 formed in the housing 22 from the back end side of the housing 22.

Figure 2:
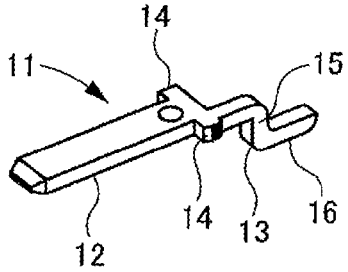
FIG. 2 is a perspective view of the terminal according to one embodiment of the invention.

As shown in FIG. 2, the terminal 11 is formed of a conductive metal material, and the front end side is formed in a tab (a connecting part) 12 connected to a female terminal of the other connector and the back end side is formed in a lead part 13. Also, in the terminal 11, locking parts 14 projecting from both lateral parts of the tab 12 are formed between the tab 12 and the lead part 13, and the lead part 13 extends from the locking part 14 of one side to the backward side. The lead part 13 is folded by pressing etc., and has a joining piece part 15 bent to the downward side and extending downwardly, and a fixing piece part 16 bent from the lower end of this joining piece part 15 to the backward side and extending backwardly.

Figure 3A:
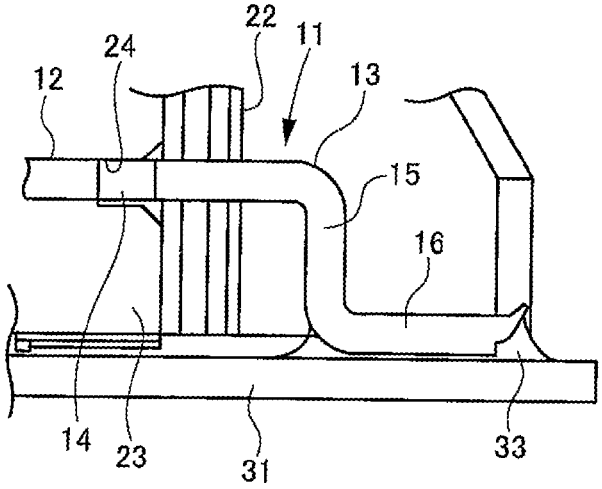
FIGS. 3(*a*) and 3(*b*) are views showing the terminal mounted on a circuit substrate, and FIG. 3(*a*) is a sectional view in the back end of the connector, and FIG. 3(*b*) is a sectional view in the back end of a lead part.
Figure 3B:
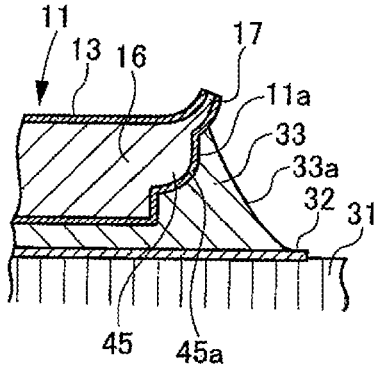

As shown in FIG. 3(*a*), when the terminal 11 is pressed in the cavity 23 of the housing 22 with the side of the tab 12 turned to the cavity 23, the locking part 14 engages with a locking groove 24 formed in the back end side in the cavity 23. Accordingly, further movement of the terminal 11 in a press-in direction is regulated inside the cavity 23 and the terminal 11 is fixed in a predetermined position.

As shown in FIG. 3(*b*), the connector 21 to which the terminal 11 is fixed is mounted on a circuit substrate 31 which is a printed substrate. Then, the fixing piece part 16 of the lead part 13 of the terminal 11 in this connector 21 is soldered to a conductor pattern 32 formed on a surface of the circuit substrate 31. Accordingly, the terminal 11 is connected to the conductor pattern 32 of the circuit substrate 31 in a conduction state.

Here, an outer surface of the fixing piece part 16 of at least the lead part 13 in the terminal 11 is previously plated with pure tin (Sn), and a tin-plated layer 11*a* is formed on the outer surface of the fixing piece part 16. As a result, in the fixing piece part 16, solder 33 well adapts to the tin-plated layer 11*a* and the fixing piece part 16 is surely conducted and connected to the conductor pattern 32. Also, in the lead part 13 of the terminal 11, a fillet forming piece 17 extending in an upwardly warped state is formed on the back end of the fixing piece part 16. Then, in the back end of the fixing piece part 16 having this fillet forming piece 17, the tin-plated layer 11*a* to which the solder 33 is fastened has a large area, and a large solder fillet 33*a* is formed in the solder 33. In addition, an end face of the fillet forming piece 17 is a cut surface of the fixing piece part 16 after the fixing piece part 16 is plated with tin, and the tin-plated layer 11*a* is not formed on this cut surface.

Figure 4:
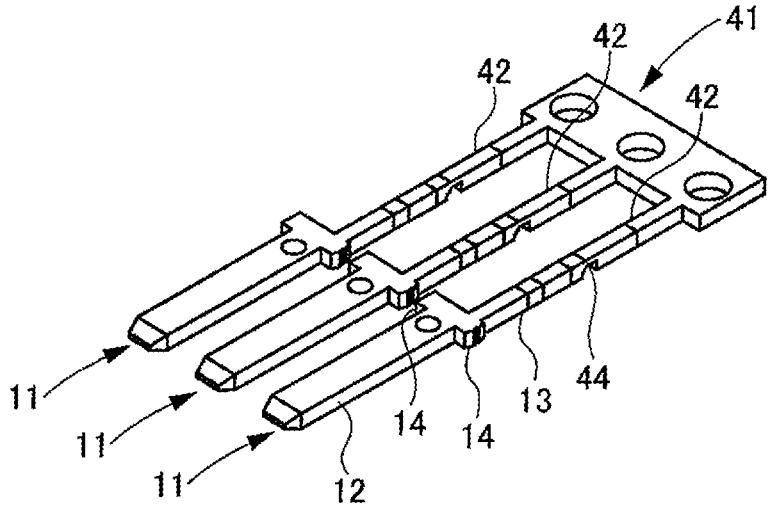
FIG. 4 is a perspective view of the terminal in a state joined to a carrier.

As shown in FIG. 4, the plural terminals 11 configured as described above are molded in a chain state joined by joining parts 42 extending from a carrier 41 by pressing a metal plate, and in this state, portions forming the fixing piece parts 16 of at least the lead parts 13 and the peripheries are plated with tin. Also, the lead parts 13 of the terminals 11 become straight in a state joined to the carrier 41, and the back ends of the lead parts 13 are mutually joined to the joining parts 42.

Figure 5:
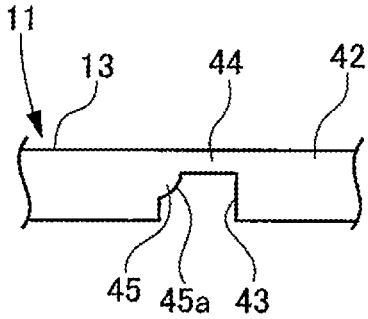
FIG. 5 is a side view of a place of joining of the terminal to the carrier.

As shown in FIG. 5, a place of joining of the lead part 13 of the terminal 11 to the joining part 42 of the carrier 41 is provided with a notch part 44 whose thickness is thinned by a recess 43 formed in the downward side in the drawing which is the surface side soldered to the conductor pattern 32. Accordingly, in the notch part 44, the lead part 13 is joined to the joining part 42 by only a thin-wall part of the upward side. Also, a guide part 45 bulging in a circular arc shape is formed in the corner in the side (left side in FIG. 5) of the lead part 13 of the recess 43 forming this notch part 44, and a surface of this guide part 45 is formed in a guide surface 45*a* with a circular arc shape.

After the plural terminals 11 joined to the carrier 41 thus are cut and separated from the joining parts 42 in the notch parts 44, the lead part 13 is folded in a predetermined shape and the joining piece part 15 and the fixing piece part 16 are formed and the terminal 11 is pressed in the cavity 23. In addition, in the terminal 11, the lead part 13 may be folded in a state joined to the carrier 41 to form the joining piece part 15 and the fixing piece part 16.

Next, cutting and separation in which the notch part 44 is cut and the terminal 11 joined to the carrier 41 is separated will be described.

Figures 6A, 6B, 6C, 6D:
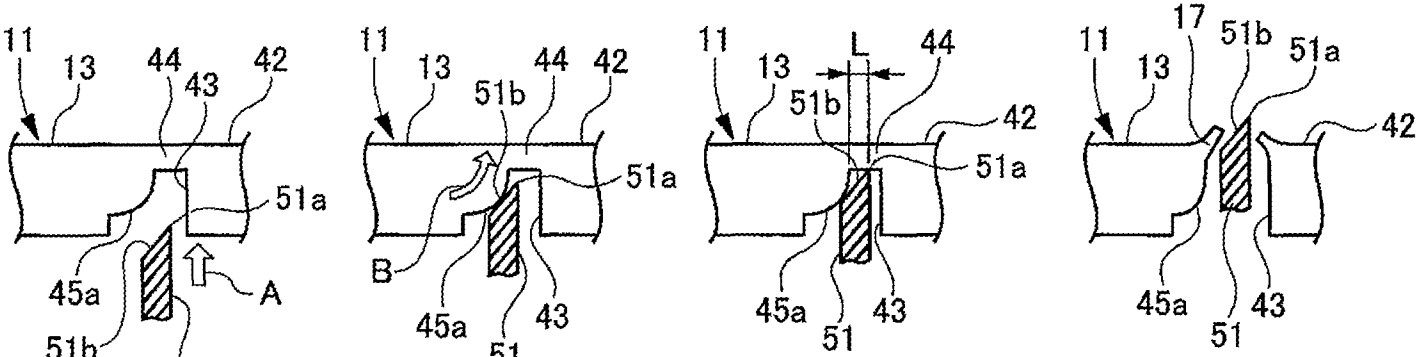
FIGS. 6(*a*) to 6(*d*) are diagrams describing a situation of cutting and separation from the carrier, and FIGS. 6(*a*) to 6(*d*) are side views of places of joining of the terminal to the carrier, respectively.
Figure 7:
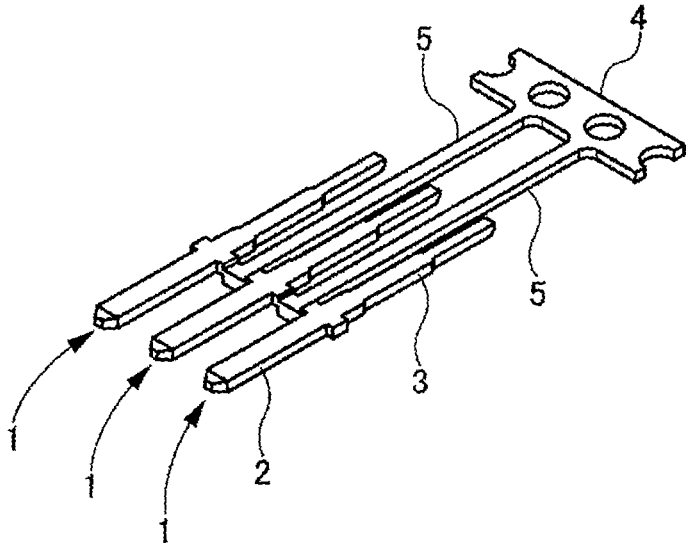
FIG. 7 is a perspective view showing a conventional example of a terminal.

FIGS. 6(*a*) to 6(*d*) are diagrams describing a situation of cutting and separation from the carrier 41, and FIGS. 6(*a*) to 6(*d*) are side views of places of joining of the terminal 11 to the carrier 41, respectively.

As shown by arrow A of FIG. 6(*a*), a blade edge 51*a* of a cutter 51 is moved dose to the notch part 44 from the downward side which is the surface side soldered to the conductor pattern 32. This cutter 51 has a taper surface 51*b* inclined to the side of the blade edge 51*a* gradually toward the top to the side of the lead part 13 of the terminal 11.

Then, when the blade edge 51*a* of this cutter 51 is moved dose to the notch part 44, the taper surface 51*b* of this cutter 51 makes contact with the guide surface 45*a* of the guide part 45 bulging in the circular arc shape before the blade edge 51*a* reaches the notch part 44 as shown in FIG. 6(*b*).

When the taper surface 51*b* is brought into contact with the guide surface 45*a* and is moved, the cutter 51 is guided along the guide surface 45*a* as shown by arrow B of FIG. 6(*b*).

Accordingly, after the blade edge 51*a* of the cutter 51 is displaced to the side of the joining part 42 in a direction away from the lead part 13, the blade edge 51*a* reaching the notch part 44 makes contact with the side of the joining part 42 in the notch part 44 as shown in FIG. 6(*c*). As a result, the cutter 51 is positioned in a state in which the blade edge 51*a* is arranged in a contact place of a dimension L from the side of the lead part 13 of the notch part 44.

When the cutter 51 is further moved in this state, the blade edge 51*a* of the cutter 51 bites into the notch part 44 and the notch part 44 is cut as shown in FIG. 6(*d*). When the cutter 51 is pushed up upwardly and enters a cut place of the notch part 44, the side of the lead part 13 and the side of the joining part 42 in the notch part 44 are deformed so as to be upwardly warped at the boundary of its cut place, and the notch part 44 is upwardly warped and extends, and the fillet forming piece 17 made of a part of the notch part 44 is formed on the back end of the lead part 13. In addition, since the cutter 51 which cuts the notch part 44 is moved while making contact with the notch part 44, the cutter 51 hardly makes contact with the tin-plated layer 11*a* of the surface of the lead part 13, so that the tin-plated layer 11*a* in the fillet forming piece 17 is not peeled by making sliding contact with the cutter 51. Also, in the case of cutting the notch part 44, there is no situation in which the cutter 51 makes sliding contact with the guide surface 45*a* of the guide part 45 and thereby a large load is applied to the lead part 13 and the lead part 13 is deformed.

As described above, in the terminal 11 cut and separated from the carrier 41, the fillet forming piece 17 extending in an upwardly warped state is formed on the back end of the fixing piece part 16 of the lead part 13. Consequently, according to this terminal 11, a large area of the tin-plated layer 11*a* to which the solder 33 is fastened can be ensured in the back end of the fixing piece part 16 having the fillet forming piece 17, and when the fixing piece part 16 is soldered to the conductor pattern 32 of the circuit substrate 31, the large solder fillet 33*a* is formed as a formation part of the solder 33. Hence, even when the joining part 42 of the carrier 41 is joined to the back end of the lead part 13 and the terminal 11 is cut and separated in this joined place, the fixing piece part 16 of the lead part 13 can extremely well be soldered and fixed to the conductor pattern 32 of the circuit substrate 31 without performing complicated post plating processing with respect to its cut place.

Also, since the back end of the terminal 11 is joined to the carrier 41, occurrence of burrs on both sides can be eliminated as compared with a conventional structure in which both sides of the intermediate part of the terminal 11 are joined to the carrier 41. Accordingly, trouble in which a creepage distance between the adjacent terminals 11 is not ensured sufficiently and a short circuit occurs can be prevented surely. Also, in the case of being pressed in the cavity 23 of the housing 22, there is no situation in which burrs chip an inner wall of the cavity 23 and the chips cause poor connection.

In addition, when the top of the tab 12 is joined to the joining part 42 of the carrier 41, burrs by cutting and separation on both sides of the terminal 11 do not occur, but in this case, burrs may occur on the top of the tab 12 and become an obstacle to connection to a female terminal of the other connector. However, in the embodiment, the joining part 42 of the carrier 41 is joined to the end of the lead part 13, so that occurrence of the burrs on the tab 12 can be prevented and hence, connection to the female terminal of the other connector can be made well and smoothly.

That is, according to the terminal 11 according to the embodiment, the terminal 11 can well be soldered to the conductor pattern 32 of the circuit substrate 31 without causing trouble such as a short circuit or poor connection.

In addition, the invention is not limited to the embodiment described above, and modifications, improvements, etc. can be made properly. Moreover, as long as the invention can be achieved, materials, shapes, dimensions, numerical values, forms, the number of components, arrangement places, etc. of each component in the embodiment described above are freely selected and are not limited.

Also, the present application is based on Japanese patent application (patent application No. 2010-288104) filed on Dec. 24, 2010, and the contents of the patent application are hereby incorporated by reference.

INDUSTRIAL APPLICABILITY

According to a terminal according to the invention, the terminal can be received in a housing of a connector and be well soldered to a substrate without causing trouble such as a short circuit or poor connection.

DESCRIPTION OF REFERENCE NUMERALS AND SIGNS

11 TERMINAL
12 TAB (CONNECTING PART)
13 LEAD PART
17 FILLET FORMING PIECE
21 CONNECTOR
22 HOUSING
31 CIRCUIT SUBSTRATE
32 CONDUCTOR PATTERN
41 CARRIER
42 JOINING PART
44 NOTCH PART
45 GUIDE PART
45*a* GUIDE SURFACE
51 CUTTER

The invention claimed is:

1. A terminal for use with a connector and engagable with another terminal of another connector, the terminal also being configured for use with a circuit substrate having a conductor pattern, the terminal comprising:

a connecting part that is connectable to the other terminal of the other connector; and a lead part that is configured to be soldered to the conductor pattern of the circuit substrate;

wherein, upon being molded, the terminal is joined to a joining part, which extends from a carrier, and the terminal is then formed via pressing of a conductive metal material and by being cut and separated from the carrier;

the lead part is plated with tin, and a notch part, whose thickness is thinned, is cut from a surface side that is soldered to the conductor pattern by a cutter, which is disposed between the lead part and the joining part; and the notch part is provided with a guide part for guiding the cutter in an upward direction to a bottom surface of the notch part, such that the cutter forms a fillet forming piece made of a portion of the notch part and disposed on a side of the lead part, the fillet forming piece defining an edge of the lead part that extends further in the upward direction than an adjacent section of the lead part.

2. The terminal as claimed in claim 1, wherein the guide part has a guide surface bulging in a circular arc shape.

3. The terminal as set forth in claim 2, wherein the guide part is substantially quadrant-shaped.

4. The terminal as set forth in claim 1, wherein a top surface of the notch part defines a plane that is perpendicular to a cutting direction.

5. The terminal as set forth in claim 3, wherein an interior side surface of the notch part that is disposed opposite to the guide part defines a plane that is parallel to the cutting direction.

6. The terminal as set forth in claim 1, wherein the terminal extends along a single plane upon being molded prior to cutting of the notch part by the cutter.

7. A combination of terminals joined to a carrier, each terminal being for use with a connector and engagable with another terminal of another connector, the terminal also being configured for use with a circuit substrate having a conductor pattern, wherein joining parts are extended from the carrier and respectively connected to the terminals, and each of the terminals includes:

a connecting part that is connectable to the other terminal of the other connector; and a lead part that is configured to be soldered to the conductor pattern of the circuit substrate, wherein the lead part is plated with tin, and a notch part, whose thickness is thinned, which is disposed between the lead part and the joining part, the notch part is provided with a guide part for guiding a cutter in an upward direction to a bottom surface of the notch part, such that the cutter forms a fillet forming piece made of a portion of the notch part, and the guide part has a guide surface bulging in a circular arc shape.

8. The combination as set forth in claim 7, wherein the guide part is substantially quadrant-shaped.

9. The combination as set forth in claim 7, wherein a surface of the terminal opposite to the notch part is flat.

* * * * *